US009341371B2

(12) United States Patent
Stifel

(10) Patent No.: US 9,341,371 B2
(45) Date of Patent: May 17, 2016

(54) CORONA IGNITION DEVICE

(71) Applicant: BorgWarner BERU Systems GmbH, Ludwigsburg (DE)

(72) Inventor: Timo Stifel, Stuttgart (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 225 days.

(21) Appl. No.: 14/161,095

(22) Filed: Jan. 22, 2014

(65) Prior Publication Data

US 2014/0211365 A1 Jul. 31, 2014

(30) Foreign Application Priority Data

Jan. 30, 2013 (DE) ..... 10 2013 100 925

(51) Int. Cl.

| | |
|---|---|
| ***F23Q 3/00*** | (2006.01) |
| ***H01F 27/30*** | (2006.01) |
| ***H01F 38/12*** | (2006.01) |
| ***H01T 13/50*** | (2006.01) |
| ***H01T 13/44*** | (2006.01) |

(52) U.S. Cl.

CPC *F23Q 3/00* (2013.01); *H01F 27/30* (2013.01); *H01F 38/12* (2013.01); *H01T 13/44* (2013.01); *H01T 13/50* (2013.01)

(58) Field of Classification Search

CPC ..... F23Q 3/00
USPC ..... 361/263
See application file for complete search history.

(56) References Cited

U.S. PATENT DOCUMENTS

| | | | | |
|---|---|---|---|---|
| 6,308,696 | B1 * | 10/2001 | Kondo et al. | 123/634 |
| 8,025,756 | B2 | 9/2011 | Roos et al. | |
| 2003/0168640 | A1 * | 9/2003 | Kirsten | 252/500 |
| 2011/0305998 | A1 | 12/2011 | Toedter et al. | |

FOREIGN PATENT DOCUMENTS

| | | | |
|---|---|---|---|
| DE | 2512714 | A * | 9/1976 |
| DE | 26 24 819 | A1 | 12/1977 |
| DE | 103 15 539 | A1 | 10/2004 |
| DE | 10 2006 007 563 | A1 | 8/2007 |
| DE | 10 2010 055 570 | B3 | 3/2012 |

(Continued)

OTHER PUBLICATIONS

Machine translation of Walthew DE 2512714 A, Vorrichtung Zum Induzieren Einer Elecktrischen Spannung, Sep. 30, 1976.*

(Continued)

*Primary Examiner* — Thienvu Tran
*Assistant Examiner* — Kevin J Comber
(74) *Attorney, Agent, or Firm* — Bose McKinney & Evans LLP

(57) ABSTRACT

The invention relates to corona ignition device comprising a housing, an insulator surrounded by the housing, an inner conductor leading through the insulator to an ignition tip, and a coil connected to the inner conductor, the coil comprising an elongate coil former and a winding formed from wire wound onto the coil former, wherein the coil former comprises at least one indentation filled with adhesive, and the wire crosses the indention such that wire portions which are arranged above the indentation are adhesively bonded to the coil former by means of the adhesive arranged in the indentation.

13 Claims, 2 Drawing Sheets

(56) References Cited

FOREIGN PATENT DOCUMENTS

| | | | |
|---|---|---|---|
| DE | 102010055570 | B3 * | 3/2012 |
| EP | 1 662 626 | A1 | 5/2006 |

OTHER PUBLICATIONS

Machine translation of Giffels et al. DE 102010055570 B3, Korona-Zundeinrichtung, Mar. 15, 2012.*

* cited by examiner

CORONA IGNITION DEVICE

RELATED APPLICATIONS

This Application claims priority to DE 10 2013 100 925.5, filed Jan. 30, 2013, the entire disclosure of which is hereby incorporated herein by reference in its entirety.

BACKGROUND

The invention relates to a corona ignition device comprising a housing, an insulator surrounded by the housing, an inner conductor leading through the insulator to an ignition tip, and a coil connected to the inner conductor. Corona ignition devices generally of this type are known from DE 10 2010 055 570 B3, U.S.2011/0305998 A1 and EP 1 662 626 A1.

If coils are exposed to jolting motions or vibrations, as occur in ignition devices, there is the risk that turns of the winding on the coil former will move. Both the function of the coil and also the service life thereof may be impaired as a result.

In order to fix wire turns on the coil former, coil windings can be sealed with synthetic resin or a silicone material. Here, it is problematic that even tiny bubbles impair the quality of the coil. In addition, thermal expansions of the sealing material may lead to the formation of cracks or splits and may thus lower the dielectric strength. Thermal expansions of the sealing material are a problem in particular with coils that are exposed to considerable temperature changes, as occur for example with ignition devices of internal combustion engines.

A further possibility for fixing wire turns on a coil former lies in providing the coil with a coating film, for example by dipping or spraying, or in winding adhesive tape around the coil, once the wire has been wound onto the coil former. Electrical properties of the coil, in particular the quality thereof, may be impaired, however, as a result.

In order to avoid undesirable movements of the wire turns on the coil former, it is also known to provide the coil former with a thread-like channel and to position the wire in this channel. This approach is very complex, however, in terms of manufacture.

A further possibility for fastening wire turns on a coil former is to apply an adhesive layer to the coil former. A problem here is that the adhesive has to be applied very uniformly in a thin layer. If, specifically, the adhesive layer thickness is too great, the wire sinks in the adhesive layer and the electrical properties of the coil are impaired, for example similarly to when fixing with a coating film applied by dipping or by spraying.

SUMMARY

The present invention provides a cost-effective way in which turns of a winding can be fixed on a coil former without impairing the electrical properties of the coil of a corona ignition device.

In a coil of a corona ignition device according to this disclosure, the wire is adhesively bonded to the coil former. The adhesive is not applied as a thin layer to the entire coil former however, but instead is arranged in one or more indentations, over which the wire runs. The wire wound onto the coil former is therefore also not adhesively bonded over its entire length to the coil former, but only to the wire portions arranged above an indentation filled with adhesive. Between the portions adhesively bonded to the coil former, the wire has portions which are arranged loosely on the coil former. Indentations, for example grooves or blind bores, can be provided with low outlay in the lateral surface of a coil former and then filled with adhesive.

In order to effectively fix a wire winding on the coil former, it is not absolutely necessary for each individual turn to be adhesively bonded to the coil former. If the indentations are formed for example as blind bores in the coil former, these can be arranged at an axial distance from one another, with the result that only each second or third turn for example crosses one of the indentations and is thus adhesively bonded to the coil former. The wire winding is, however, naturally fixed better onto the coil former, the more wire turns are adhesively bonded to the coil former. At least half, particularly preferably at least ¾, in particular at least ⅘, for example at least 9/10 of the turns, or even all of the turns are therefore preferably adhesively bonded to the coil former, that is to say cross an indentation filled with adhesive.

In accordance with an advantageous refinement of this disclosure, the at least one indentation filled with adhesive is a groove, preferably a groove running in the longitudinal direction of the coil former. A groove can be produced in the coil former with low manufacturing outlay and filled very easily with adhesive. If the groove extends in the longitudinal direction over the entire winding surface of the coil former, such a groove may adhesively bond an accordingly high number of turns to the coil former, specifically in the ideal case all the turns of a coil.

The groove can extend in a straight line, parallel to the longitudinal axis of the coil former. It is also possible, however, to provide the groove at an incline to the longitudinal axis of the coil former or in a wavy manner on the lateral surface of the coil former. Any groove running transverse to the turns of the wire winding is suitable per se.

The coil former may have a plurality of grooves filled with adhesive, which are arranged side by side on the coil former. The grooves can run parallel to one another. Since a plurality of grooves, preferably 2 to 6 grooves, are arranged on the coil former, the individual turns of the wire winding can be adhesively bonded to the coil former at a corresponding number of portions and thus effectively fixed to the coil former.

BRIEF DESCRIPTION OF THE DRAWINGS

Further details and advantages of this disclosure will be explained hereinafter on the basis of an illustrative embodiment with reference to the accompanying drawings, in which.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
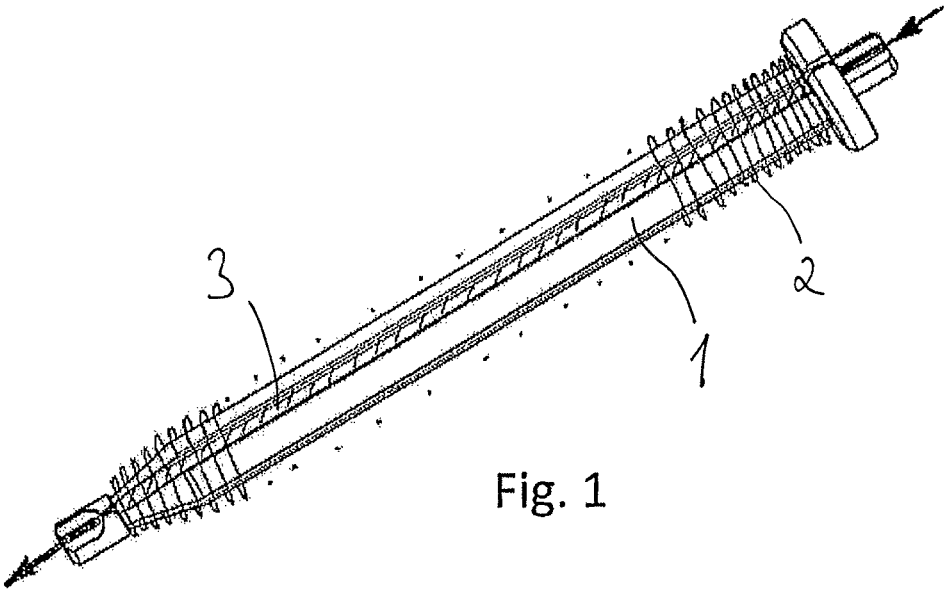
FIG. 1 shows a schematic illustration of an illustrative embodiment of a coil according to this disclosure.

The coil illustrated in FIG. 1 has an elongate coil former 1, onto which a wire 2 is wound. The wound-on wire 2 forms the winding of the coil. This winding is illustrated only schematically in FIG. 1 at the end portions of the coil former 1.

Figure 2:
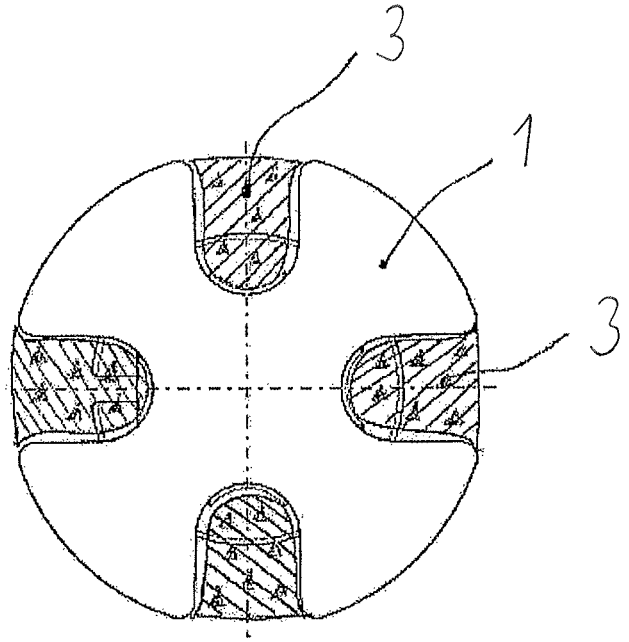
FIG. 2 shows a sectional view of the coil former of the coil of FIG. 1 with adhesive-filled indentations.

As FIG. 2 shows in particular, the coil former 1 in its lateral surface has a plurality of indentations, which are filled with adhesive 3. The wire 2 wound onto the coil former 1 crosses these indentations, that is to say has portions which are arranged above the indentations, and therebetween may be arranged loosely on the coil former 1. The wire portions arranged above such an indentation are adhesively bonded to the coil former 1 by the adhesive 3 arranged in the indentation.

The indentations can be formed arbitrarily per se. In the illustrated illustrative embodiment, the indentations are formed as grooves. These grooves run parallel to one another in the longitudinal direction of the coil former 1.

The indentations preferably widen towards their opening, that is to say towards the lateral surface of the coil former 1. The edges of the individual indentations are rounded. The electrical properties of the coil can thus be improved. In particular, the creation of field peaks, which increase the risk of voltage flashovers, can be avoided. The adhesive 3 may contain an electrically or magnetically effective filler, for example ferrite powder, ceramic powder and/or metal powder. The inductance of the coil and the quality thereof can thus be adapted or optimized.

The adhesive 3, for example, may be a thermoplastic adhesive or a curing adhesive. If an adhesive is used that expands as it cures, the indentations are not filled completely with adhesive, and therefore the wire 2 when wound onto the coil former 1 initially has no contact with the adhesive 3. As it cures, the adhesive 3 then expands, and therefore portions of the wire 2, which bridge over the indentations, come into contact with the adhesive 1 and are thus adhesively bonded to the coil former 1. It is also possible to use a curing adhesive of which the volume reduces as it cures. In this case, the indentations are filled completely with adhesive. Even when winding on the wire 2, wire portions that bridge over the indentations are then in contact with the adhesive 3. If the adhesive then cures and its volume reduces, portions of the wire 2 arranged above the indentations may deflect slightly into the indentations.

The coil former 1 may have a tapering end portion, which is surrounded by turns of the winding. A tapering end portion of the coil reduces the risk that field elevations are formed in the connection region of the coil and thus reduces the risk of voltage flashovers, for example with use of the coil in a corona ignition device. The indentations formed as grooves also extend in the tapering end portion. In this end portion too, the turns are thus adhesively bonded to the coil former 1.

The grooves may extend over the entire winding surface of the coil former 1, such that all turns of the coil are adhesively bonded to the coil former 1, that is to say adhesively bonded wire portions follow one another at a distance of less than one peripheral length of the coil former 1. In order to fix the wire winding on the coil former 1, it is sufficient however if only some of the turns are adhesively bonded to the coil former 1.

Figure 3:
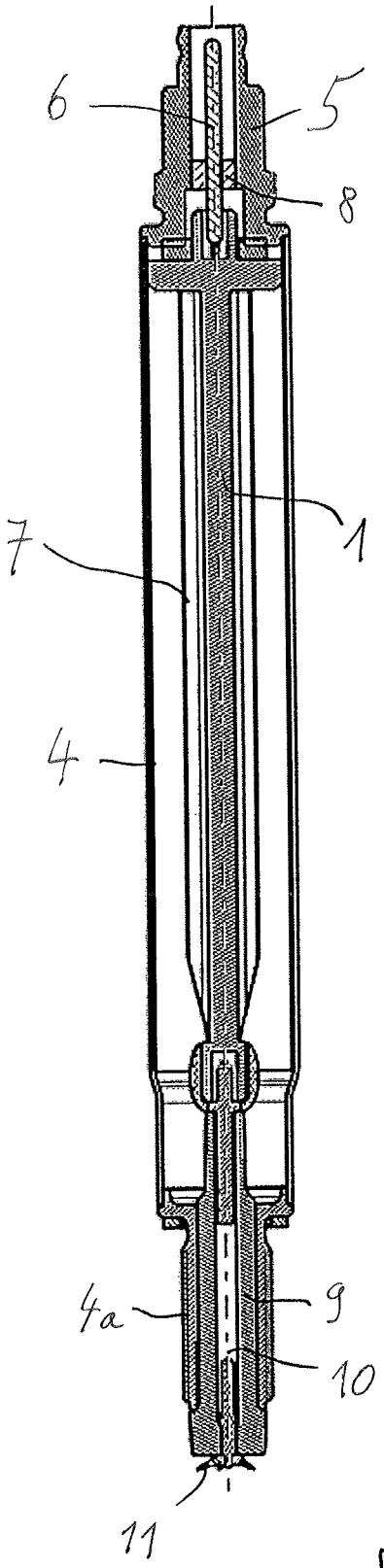
FIG. 3 shows a schematic illustration of an illustrative embodiment of a corona ignition device with the coil illustrated in FIG. 1.

An embodiment of a corona ignition device with the coil 7 of FIG. 1 is illustrated schematically in FIG. 3. The corona ignition device has a housing 4, which is connected in a gas-tight manner to the outer conductor 5 of an HF plug-type connector, for example by means of welding. The inner conductor 6 of the HF plug-type connector is connected to the coil 7. The inner conductor 6 may be surrounded by a seal 8, for example a glass seal.

In the illustrated embodiment, the housing 4 consists of a plurality of parts, specifically a housing tube, in which a coil 7 is arranged, and a housing head 4*a*, which surrounds an insulator 9. The coil former 1 of the coil 7 may at one end carry a bushing, into which the inner conductor 10 of the corona ignition device can be inserted. The inner conductor 10 may thus be connected to the coil 7.

The housing head 4*a* in the illustrated embodiment comprises an outer thread for screwing into an engine block. An outer thread is not necessary however, since the corona ignition device can also be fastened to the engine block in a different way.

The inner conductor 10 leads through the insulator 9 to one or more ignition tips 11. The housing head 4*a*, together with the inner conductor 10 and the insulator 9, forms a capacitor. This capacitor is connected in series to the coil 7 and forms an electric resonating circuit therewith. By exciting this resonating circuit, a corona discharge can be produced starting from the ignition tips 11.

While exemplary embodiments have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE NUMBERS

1 coil former
2 wire
3 adhesive
4 housing
4*a* housing head
5 outer conductor
6 inner conductor
7 coil
8 seal
9 insulator
10 inner conductor
11 ignition tip

What is claimed is:

1. A corona ignition device, comprising:

a housing;

an insulator surrounded by the housing;

an inner conductor leading through the insulator to an ignition tip;

a coil connected to the inner conductor, the coil comprising an elongate coil former having an indentation filled with adhesive, wherein the indentation projects inward from the surface of the coil former and wherein the indentation extends along the longitudinal axis of the coil former; and a winding formed from wire wound onto the coil former and crossing the indention, wherein wire portions which are arranged above the indentation are adhesively bonded to the coil former by the adhesive, further wherein each turn of the wire wound onto the coil former is adhesively bonded only along part of the coil former's circumference.

2. The corona ignition device according to claim 1, wherein the indentation is a groove.

3. The corona ignition device according to claim 2, wherein at least half of the turns of the winding cross the groove.

4. The corona ignition device according to claim 2, wherein all turns of the winding cross the groove.

5. The corona ignition device according to claim 2, wherein the groove comprises a plurality of grooves filled with adhesive arranged side by side and the grooves are crossed by the wire.

6. The corona ignition device according to claim 1, wherein the indentation widens towards its opening.

7. The corona ignition device according to claim 1, wherein the coil former has a tapering end portion surrounded by the wire.

8. The corona ignition device according to claim 7, wherein at least half of the turns which surround the tapering end portion cross the indentation.

9. The corona ignition device according to claim 1, wherein the adhesive contains an electrically or magnetically effective filler.

10. The corona ignition device according to claim 9, wherein the filler is ferrite powder, ceramic powder and/or metal powder.

11. The corona ignition device according to claim 1, wherein the adhesive comprises a curing adhesive.

12. The corona ignition device according to claim 1, wherein the adhesive expands as it cures.

13. A corona ignition device, comprising:

a housing;

an insulator surrounded by the housing;

an inner conductor leading through the insulator to an ignition tip;

a coil connected to the inner conductor, the coil comprising an elongate coil former having an indentation filled with adhesive, wherein the indentation extends along the longitudinal axis of the coil former; and a winding formed from wire wound onto the coil former and crossing the indention, wherein wire portions which are arranged above the indentation are adhesively bonded to the coil former by the adhesive;

wherein the coil former has a tapering end portion surrounded by the wire and wherein adhesive is not present along the entire circumference of the coil former.

* * * * *